US007048167B2

(12) United States Patent
Keller et al.

(10) Patent No.: US 7,048,167 B2
(45) Date of Patent: May 23, 2006

(54) COMBUSTION-DRIVEN SETTING TOOL FOR FASTENING ELEMENTS

(75) Inventors: Kai-Uwe Keller, Feldkirch-Tisis (AT); Stefan Boenig, Wassserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 43 days.

(21) Appl. No.: 10/739,865

(22) Filed: Dec. 18, 2003

(65) Prior Publication Data

US 2004/0182335 A1 Sep. 23, 2004

(30) Foreign Application Priority Data

Dec. 19, 2002 (DE) ..... 102 59 817

(51) Int. Cl.
*B25C 1/12* (2006.01)

(52) U.S. Cl. ..... 227/10; 123/46 H; 123/46 SC

(58) Field of Classification Search ..... 123/46 H, 123/46 SC, 24 R, 24 A; 227/10
See application file for complete search history.

(56) References Cited

U.S. PATENT DOCUMENTS 3,341,101 A 9/1967 Butler et al.
3,804,314 A 4/1974 Gilbert
4,483,474 A * 11/1984 Nikolich ..... 123/46 SC
4,721,240 A * 1/1988 Cotta ..... 227/10
5,197,646 A * 3/1993 Nikolich ..... 123/46 SC
6,019,072 A * 2/2000 Phillips et al. ..... 123/46 H
6,123,243 A 9/2000 Pfister et al.
6,808,100 B1 * 10/2004 Fielitz et al. ..... 227/10

FOREIGN PATENT DOCUMENTS

DE 2259130 6/1974
DE 2750629 5/1979
DE 20109165 10/2001
WO 0121359 3/2001

* cited by examiner

*Primary Examiner*—Erick Solis
(74) *Attorney, Agent, or Firm*—Abelman, Frayne & Schwab

(57) ABSTRACT

The invention relates to a combustion-driven setting tool for fastening elements having a housing (1), a piston guiding cylinder (22), which is displaceably mounted in the unit housing in the cylinder longitudinal direction, a piston (21) guided in the piston guiding cylinder (22) for driving a fastening element (13) into a receiving material (18), a receiving assembly (12) situated coaxial to the piston guiding cylinder (22) for the fastening element (13), as seen in the driving direction, lies in front of the piston guiding cylinder (22) and is displaceable relative to same; an elastic adjusting assembly (30), which constantly tends to separate receiving assembly (12) and the piston guiding cylinder (22) from each other; and a piston mounting (31), which is attached to the on the end of the receiving assembly (12) facing towards the piston guiding cylinder (22).

8 Claims, 8 Drawing Sheets

COMBUSTION-DRIVEN SETTING TOOL FOR FASTENING ELEMENTS

BACKGROUND OF THE INVENTION

The invention relates to a combustion driven setting tool for driving fastening elements such as known from DE-OS 22 26 598, for example. This type of known setting tool is comprised of a housing; a piston guiding cylinder which is displaceably mounted in the direction of the cylinder longitudinal axis of its cylinder in the housing; a piston guided in the piston guiding cylinder for driving a fastening element into a receiving material; a receiving assembly for the fastening element lying coaxial to the piston guiding cylinder, which when viewed in the driving direction lies in front of the piston driving cylinder and is displaceable relative to same; and an elastic setting device, that permanently acts to separate the receiving assembly and the piston guiding cylinder.

In the case of the known setting tool, a fastening element is placed in the receiving device, whereby the fastening element projects forward beyond the receiving assembly. If the setting tool is then urged with its opening against a receiving material, the fastening element is initially supported on the receiving material and urges the piston rearwardly into its starting position in the piston guiding cylinder. Then a further displacement of the piston guiding cylinder and the receiving assembly occurs in the direction towards the rear end of the setting tool, in order to receive a cartridge. If ignition occurs in this condition, then a very powerful recoil occurs, because the force is transmitted via the fastening element directly to the setting tool. In addition, it is a drawback in that in the case of the known setting tool, only fastening elements of a pre-determined length can be used, for which purpose the opening end of the piston has an additional recess.

SUMMARY OF THE INVENTION

The object of the invention is to develop a setting tool of the aforementioned type so that it operates without recoil and can be used with fastening elements of different lengths.

The solution of this object is achieved in that in addition a piston mounting is provided, which is attached to the trailing end of the receiving assembly.

In the case of the setting tool according to the invention, the return of the piston into its rearmost starting position in the piston guiding cylinder is not done by the use of the fastening element but by utilizing the receiving assembly itself To this end it has the piston mounting on its end facing the piston guiding cylinder, in order to move back the piston into its rearmost starting position in the piston guiding cylinder, when the setting tool is urged with its opening against the receiving material and the receiving assembly moves rearwardly or into the interior of the setting tool. Since the fastening element is no longer required to do this, it no longer needs to have a pre-determined length to also be able to urge against the receiving material. Accordingly, fastening elements can also be used, that are shorter than the inner channel of the receiving assembly, so that there are more options in the selection of fastening elements. On the other hand, in the case of a fastening element that is shorter than the length of the inner channel of the receiving assembly, there is no longer such a powerful recoil transmitted to the setting tool, because the fastening element can never support itself both on the receiving material and on the opening end of the piston.

According to an advantageous embodiment of the invention, the piston mounting is so formed, that when the piston is driven a frictional force exists between it and the piston, when the piston moves in the driving direction; that is, in the direction towards the opening of the setting tool or the piston mounting moves opposite to the driving direction. In particular, the piston mounting may have roller elements, which contact the periphery of the piston when it is withdrawn and urge against it, when the piston moves in the driving direction or the piston mounting moves opposite to the driving direction. For this purpose, the roller elements can be spheres, cylinders or the like. They then do not urge against the piston, when it moves opposite to the driving direction or the piston mounting moves in the driving direction, so that in this case there is no friction between the roller elements and the piston.

According to a further development of the invention, the receiving assembly moves into a guide assembly at its end opposite to the driving direction, the guide assembly being displaceably held in the housing in the longitudinal direction of the piston guiding cylinder and on the other hand displaceably receives the piston guiding cylinder. For this purpose, the guide assembly can be configured also as a guide sleeve lying coaxially to the central axis of the piston or the piston guiding cylinder. In this way a simple mounting of the piston guiding cylinder and the receiving assembly relative to each other is achieved in the housing and, in addition, there is the possibility of no longer providing the elastic adjustment assembly on the inside of the piston guiding cylinder but external to the piston guiding cylinder. Accordingly, the piston can be reliably guided over an extended path within the piston guiding cylinder.

As the elastic adjustment assembly, for example, a compression spring can be used, which is arranged between the inner stop in the rear end of the piston guiding cylinder setting direction and an inner stop of the guide assembly or the guide sleeve arranged farther forward in the driving direction.

However, it is also possible to provide a compression spring as the elastic adjusting assembly, which is arranged within the guide assembly or the guide sleeve between the piston mounting and the piston guiding cylinder.

In both of the aforementioned cases the compression spring is no longer exposed to the hot combustion gases; hence, it service life is extended.

In the case of the setting tool according to the invention, it is provided that the end of the piston guiding cylinder in the driving direction carries a piston brake bearing. It is used for stopping the piston and establishes the position of the piston inside the piston guiding cylinder. In this case it can also be provided that the piston brake bearing can be separated from the piston guiding cylinder and the compression spring is arranged between the piston mounting and the piston brake bearing. Forces, that occur after ignition and upon the subsequent stopping of the piston are then led via the piston brake bearing, the piston mounting and the receiving assembly into the receiving material. Accordingly, the piston guiding cylinder is not stressed, which prolongs its service life.

BRIEF DESCRIPTION OF THE DRAWING

The drawing represents exemplary embodiments of the invention. Wherein.

DETAILED DESCRIPTION OF THE INVENTION

In the following, a first exemplary embodiment of a setting tool according to the invention will be more completely described with reference to FIGS. 1 to 4. As in the second exemplary embodiment of the invention, this is a powder-charge operated setting tool, in which cartridges are used. The invention, however, is not limited hereto. The setting tool could also be operated using a combustible gas mixture, which is generated inside the combustion chamber by the supply of gaseous or liquid fuel and by the mixing with oxygen.

Figure 1:
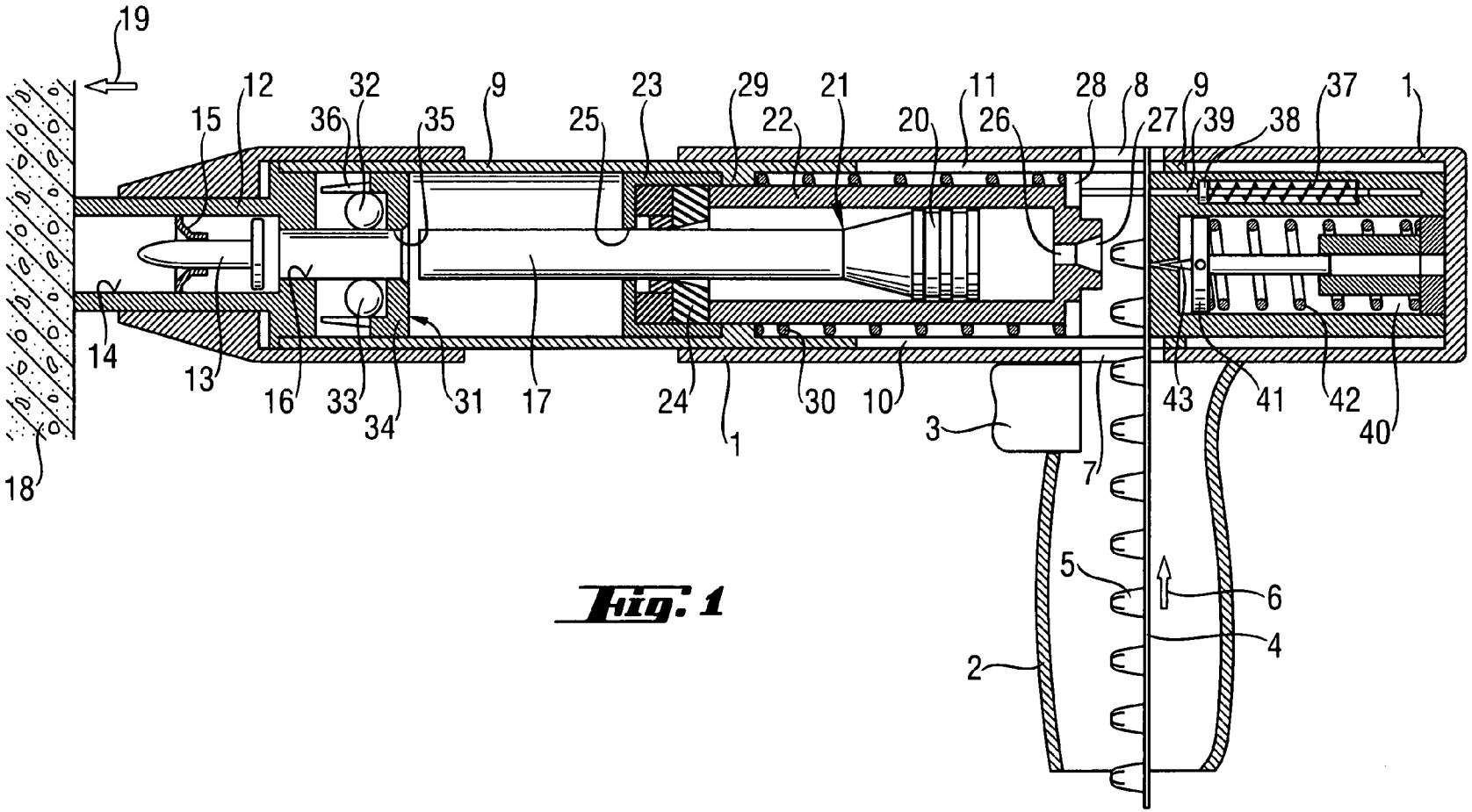
FIG. 1 represents an axial section through a setting tool according to a first exemplary embodiment in the extended state.

According to FIG. 1, the setting tool has a housing 1 connected with a handle 2, on which a switch or a trigger 3 is mounted for igniting the setting tool. A cartridge magazine 4 with cartridges 5 connected to each other, which can also be arranged as blister cartridges, a magazine transport device 6 is fed through the handle 2 to the housing 1. In this case, the respective cartridges 5 sequentially enter in a so-called firing position, in which they can be fired, as will be described below. The cartridge—magazine 4 is transported through openings 7, 8 in the housing 1.

The housing 1 is closed at the rear end of the setting tool and open on the front end, whereby the forward end faces in the direction towards the opening of the setting tool. In this front end a guide sleeve 9 is slidingly displaceably inserted.

The guide sleeve 9 is displaceably mounted in its longitudinal direction; thus, in the longitudinal direction of the setting tool. The sleeve has axial longitudinal slots 10 and 11, through which the cartridge magazine 4 can pass through. The guide sleeve 9 thus comes to lie in its longitudinal direction before and after the cartridge—magazine 4, whereby the longitudinal slots 10 and 11 are relatively long as a result of the relatively large axial displacement track of the guide sleeve 9. They align with the openings 7, 8, which are provided in the housing 1 for the passage through of the cartridge magazine 4.

The guide sleeve 9 is fixedly connected at its opening-side end; that is, left in FIG. 1, with a receiving assembly 12 for fastening elements 13. The receiving assembly 12 thus participates in the axial displacement of the guide sleeve 9. Accordingly, the receiving assembly 12 has a muzzle passage 14, in which the fastening element 13 comes to rest. The diameter of the muzzle passage 14 corresponds to the external diameter of the guide element 15 connected with the fastening element 13, while the axial length of the muzzle passage is larger than the axial length of the fastening element. The fastening element 13 is fed via its lateral opening to the receiving assembly 12 (not shown here). For this purpose the fastening element 13 comes to lie relatively far behind in the muzzle passage 14. The receiving assembly 12, in addition, has at its end facing away from the muzzle a passage 16, through which a piston rod 17 runs, in order to drive the fastening element 13 out of the muzzle passage 14 and into a receiving material 18. This advance direction of the piston rod 17 is called the driving direction 19 in the following. The receiving assembly 12 forms the muzzle of the setting tool.

The piston rod 17 is connected in one piece with a radially expanded piston head 20 arranged opposite to it, wherein the piston rod 17 and the piston head 20 form a driving piston 21. The driving piston 21 is mounted axially displaceable with its piston head 20 into a piston guiding cylinder 22. For this purpose, the piston head 20 is slidingly guided from same over the entire length of the piston guiding cylinder 22.

A piston brake bearing 23 is fixedly connected to the muzzle-side end of the piston guiding cylinder 22. A piston brake bearing 23 is configured cylindrically pot-shaped and is arranged displaceably sliding within the guide sleeve 9. The peripheral edge of the piston brake bearing 23 wraps around the muzzle-side end of the piston guiding cylinder 22 and receives a damping cushion 24, against which the piston head 20 strikes, when the piston rod 17 is driven through the base-side opening 25 of the piston brake bearing 23 in the direction towards the muzzle.

The end of the piston guiding cylinder 22 facing away from the muzzle is closed and has an axial passage channel 26, which expands funnel-like in the direction towards the rear end of the setting device, in order to form an ignition chamber 27, which can receive a cartridge 5 situated in the firing position.

At its end facing away from the muzzle of the setting tool, the piston guiding cylinder 22 has a peripheral flange 28, which projects radially over the piston guiding cylinder 22 and fittingly lies in the guide sleeve 9. Relative to this peripheral flange 28, offset in the direction towards the muzzle, the guide sleeve 9 has an inner peripheral flange 29, which fittingly receives the piston guide cylinder 22. A helical compression spring 30 is arranged between this inner peripheral flange 29 and the peripheral flange 28, which in the compressed state tends to urge, when viewed in the axial direction, the inner peripheral flange 29 away from the peripheral flange 28; that is, in the direction towards the muzzle. This occurs until the inner peripheral flange 29 impacts against the peripheral edge of the pot-shaped configured piston brake bearing 23. The compression spring 30 is used here as an extension spring for the guide sleeve 9. Because the peripheral edge of the pot-shaped configured piston brake bearing 23 only minimally overlaps the piston guiding cylinder 22 and, because the axial length of the inner peripheral flange 29 is only minimal, there is a relatively large displacement path between the piston guiding cylinder 22 and the guide sleeve 9.

A piston mounting 31 is fastened at the end of the receiving assembly 12 facing away from the muzzle. The piston mounting 31, that participates in the movement of the receiving assembly 12 or the guide sleeve 9, has in the present case two braking spheres 32, 33, which are held in a pot-shaped cage 34, which opens in the direction towards the muzzle and has a passage opening 35 for the piston rod 17 on the floor side. With the aid of an axially slotted and conically extending, annular spring cage 36, the braking spheres 32, 33 are urged radially inwardly, whereby, however, as viewed axially, cannot fallout of the pot-like cage 34. The annular spring cage 36 is configured conically and opens in the direction facing the rear end of the setting tool. If, upon displacement of the piston mounting 31, the braking spheres 32, 33 run opposite to the driving direction 19 on the piston rod 17, then they move by virtue of friction towards the narrowing end of the spring cage 36 and urge more strongly on the piston rod 17, which has the effect that the piston rod 17 is accordingly moved; that is, opposite to the driving direction 19. If, in contrast, the piston mounting 31 moves relative to the piston rod 17 in the driving direction 19, the braking spheres 32, 33 are transported into the widening zone of the spring cage 36 and practically release the piston rod 17, since there is no longer any pressure force transmitted to it.

At the rear end of the housing1 or at the side of the cartridge magazine 4 facing away from the muzzle, there is a more powerful compression spring 37 situated opposite to the compression spring 30, which acts in the longitudinal direction of the setting tool. This compression spring 37 is supported with its rear end on the housing 1 and urges with its muzzle-side end against the adjusting disk 38, which is fixedly connected to the pull rod 39, which urges against the peripheral flange 28 on the piston guiding cylinder 22. The assembly comprised of the compression spring 37, the disk 38 and the pull rod 39 is used to transport the piston guiding cylinder 22 after an ignition out of the firing position towards the muzzle, so that a new cartridge 5 can be brought into the firing position.

In the mentioned rear end of the unit housing 1, there is an inner channel 40 running in the longitudinal direction of the setting tool for receiving a guide disk 41, whose disk stands perpendicular to the longitudinal direction of the inner channel 40. Between the guide disk 41 and the rear end of the housing 1, there is a compression spring 42 which tends to drive the guide disk 41 in the direction of the muzzle of the setting tool. On the side of the guide disk 41 facing towards the muzzle, there is a firing pin, with the aid of which the compression spring 42 can be driven into a firing channel 44, in order to fire a cartridge 5 situated in the firing position. For this purpose, the firing channel 44 extends up to the rear surface of the cartridge 5, so that the firing pin 43 can penetrate into the cartridge 5 from the rear. The guide disk 41 is carried by the guide sleeve 9 via a drive mechanism (not shown), when the guide sleeve 9 is shifted opposite the driving direction 19. The compression spring 42 is accordingly tensioned. If the trigger 3 is operated, the guide disk 41 is released and the compression spring 42 can drive the firing pin 43 in the direction of the muzzle or the cartridge 5, in order to fire it.

In the following the mode of operation of the setting tool according to the first exemplary embodiment will be more completely described.

In FIG. 1 the setting tool is in the fully extended state. The compression spring 37 has urged the piston guide cylinder 22 via the rod 39 and the peripheral flange 28 in the direction towards the muzzle, so that now cartridge transport is possible and an unused cartridge 5 can be brought into the firing position by virtue of the movement of the cartridge magazine 4 in the magazine transport direction 6. It is presumed, that this has already happened in FIG. 1. The compression spring 42 is still not compressed and the compression spring 30 is supported between the peripheral flange 28 and the inner peripheral flange 29 and consequently urges the guide sleeve 9 out of the housing 1. A fastening element 13 is situated inside the muzzle passage 14 for the next setting operation. The driving piston 21 is situated with its piston head 20 at any position of the piston guiding cylinder 22.

Figure 2:
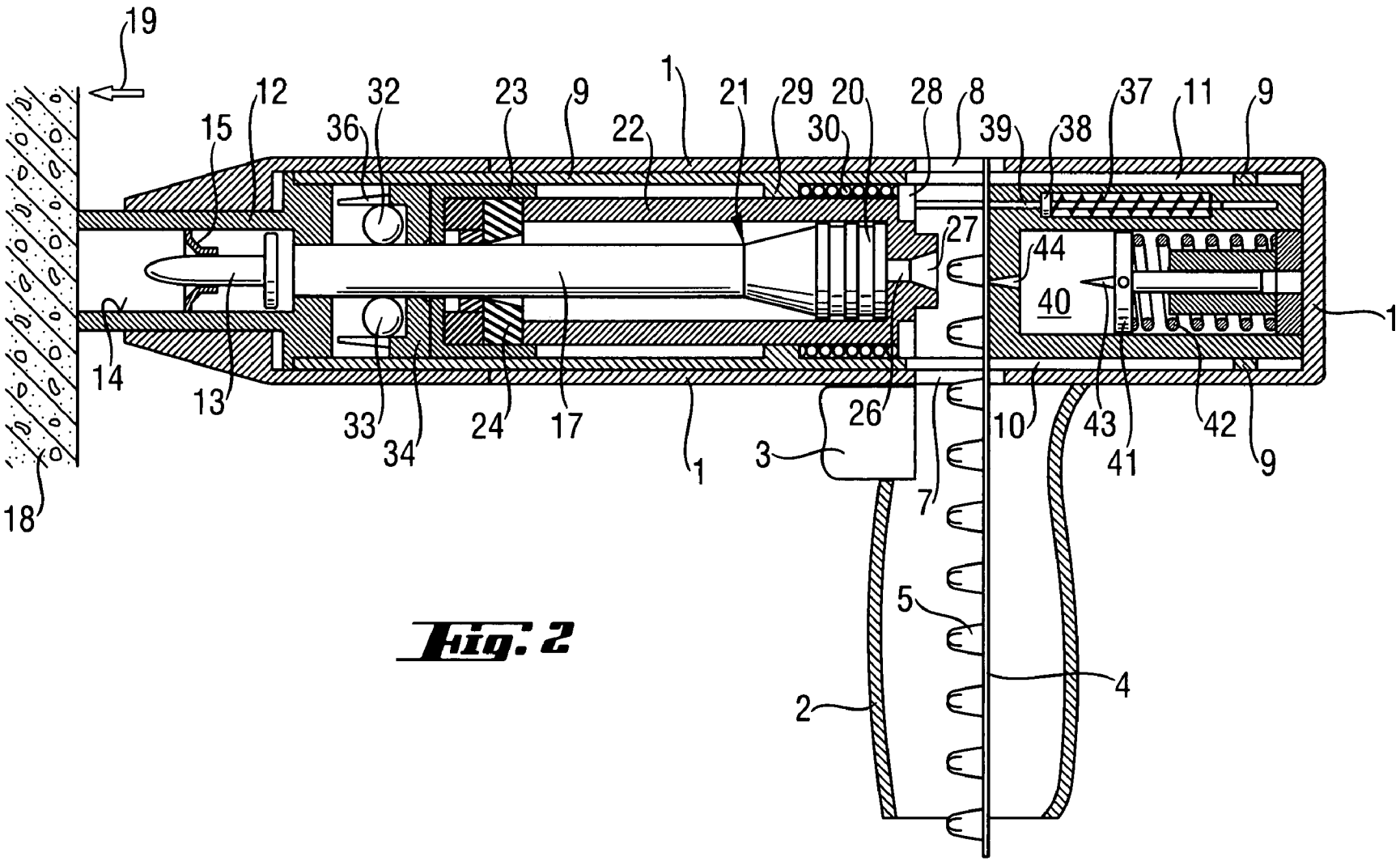
FIG. 2 represents the setting tool according to FIG. 1 upon application on the receiving material.

If now the setting tool according to FIG. 2 is urged with its muzzle against the receiving material 18, thus to the left in FIG. 2, then the compression spring 30 is compressed by means of the receiving assembly 12 and, the guide sleeve 9. The guide cylinder 22 is not yet shifted opposite to the driving direction 19, because it is still prevented from doing so by the action of the compression spring 30. At the same time as the shift of the receiving assembly 12 opposite to the driving direction 19 in FIG. 2, the piston mounting 31 is correspondingly transported, so that the braking spheres 32, 33 run up to the piston rod 17 and the driving piston 21 in the direction towards the rear end of the piston guiding cylinder 22. The piston head 20 now closes with its back side the axial passage channel 26. The pot-shaped cage 34 abuts on the piston brake bearing 23. In addition, the guide disk 41 is correspondingly taken along by the guide sleeve 9 or moved rearwardly; that is, away from the muzzle, so that now the compression spring 42 is partially compressed.

Figure 3:
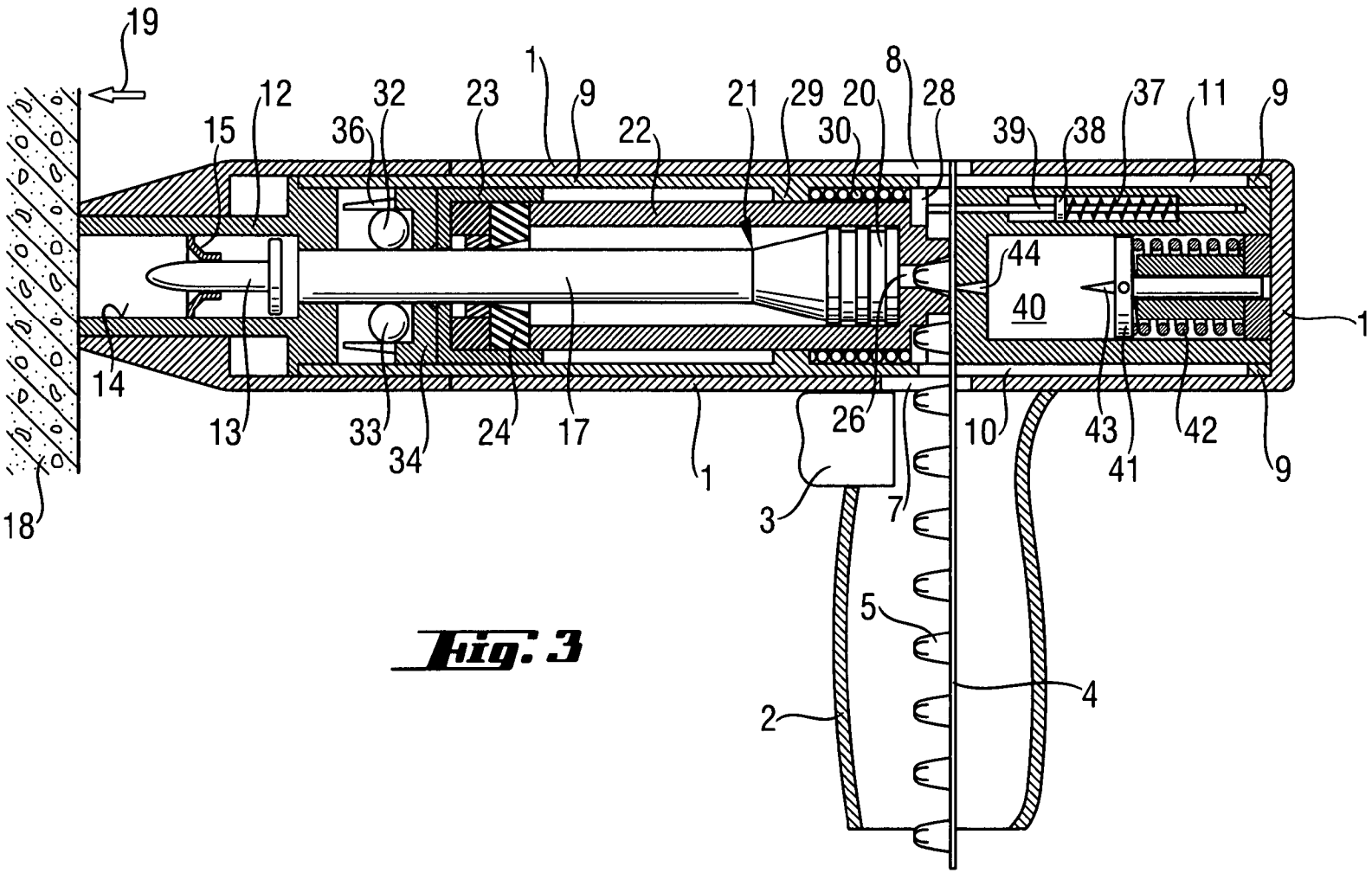
FIG. 3 represents the setting tool according to FIG. 1 in the applied state.

If, according to FIG. 3, the setting tool is more forcefully urged against the receiving material 18, the compression spring 37 situated in the rear part of the unit housing 1 is compressed by means of the receiving assembly 12, the piston mounting 31, the piston brake bearing 23, the piston guide cylinder 22 and the peripheral flange 28. The guide sleeve 9 also participates in this movement so that the guide disk 41 is also moved farther rearwardly, so that now the compression spring 42 is now maximally compressed. As a consequence of the aforesaid shift of the piston guiding cylinder 22, the firing chamber now surrounds the cartridge 5 situated in the firing position, so that now the trigger 3 can be operated.

Figure 4:
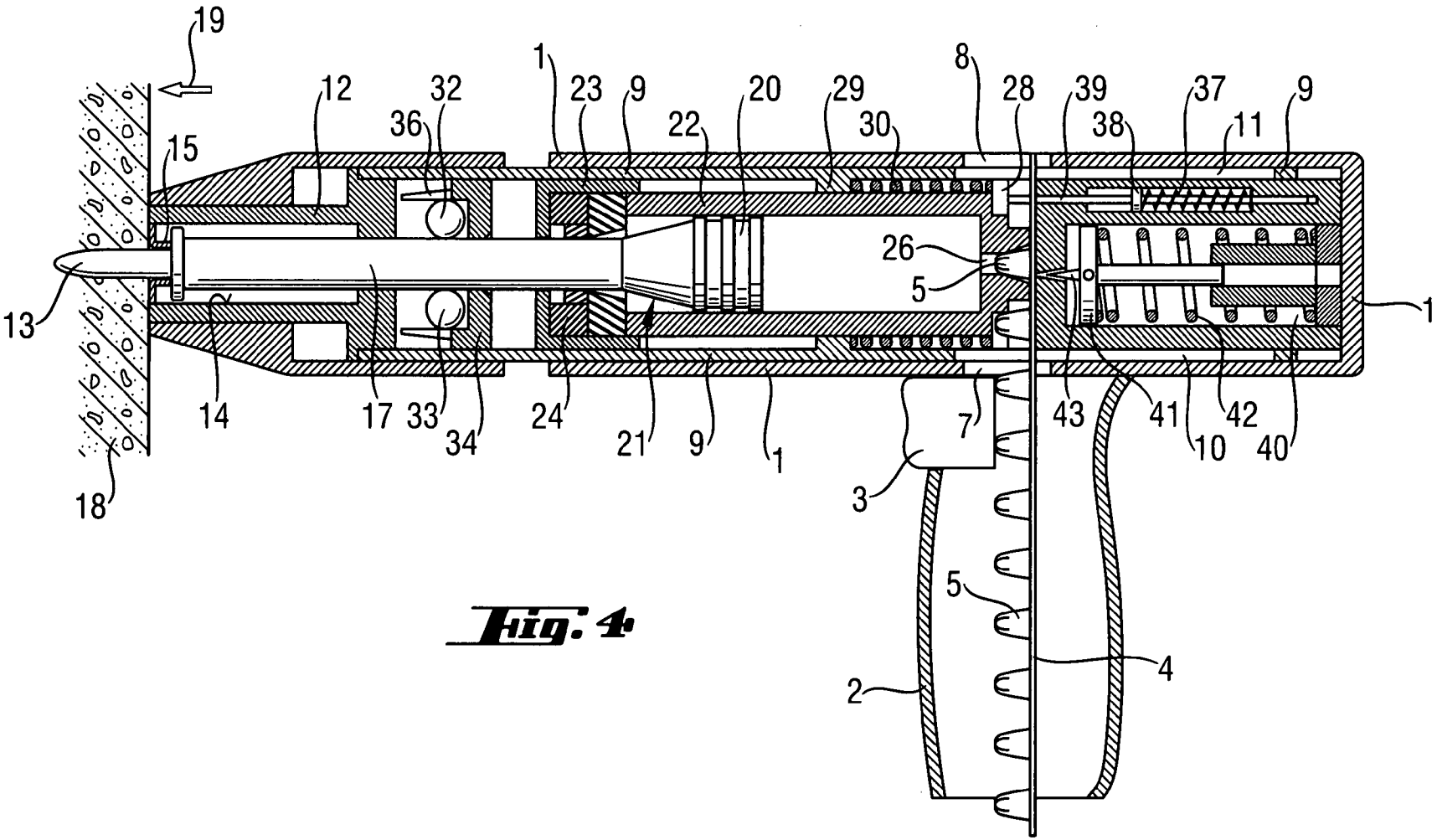
FIG. 4 represents the setting tool according to FIG. 1 after setting a fastener and not yet in the extended state.

When the trigger 3 is operated, the guide disk 41 is unlocked and the compression spring 42 can drive the firing pin 43 into the firing channel 44, so that now the cartridge situated in the firing position is fired. This state is represented in FIG. 4. The explosive pressure drives the driving piston 21 in the direction towards the muzzle, whereby it runs initially between the braking spheres 32, 33. When this occurs, the energy of the driving piston 21 is so high that the braking action of the braking spheres 32, 33 can be ignored in this case. The fastening element 13 is driven into the receiving material 18. In by virtue of the slight recoil generated when this happens the housing 1 is moved slightly rearward, whereby the compression spring 30 is slightly compressed.

If now, with reference to FIG. 4, the setting tool is removed entirely from the receiving material, then on the one hand the compression spring 37 urges, via the peripheral flange 28 the piston guiding cylinder 22, the piston guiding cylinder 22 in the direction of the muzzle, so that a cartridge 5 replacement is possible. Furthermore, the compression spring 30 also is effective and urges the guide sleeve 9 over the inner peripheral flange 29 out of the housing 1 in the direction of the muzzle, whereby the compression spring 30 rests on the peripheral flange 28. The receiving assembly 12 and the piston mounting 31 also participate in this movement of the guide sleeve 9. The piston rod 17 is not taken along by the braking spheres 32, 33, because in this case the braking spheres 32, 33 run rearwardly out of the spring cage 36. The spring cage 36 thus exerts a pressure force on the braking spheres 32, 33 in the direction towards the piston rod 17. By virtue of the friction between the piston head 20 and the inner wall of the piston guiding cylinder 22, the driving piston 20 thus remains in its position. Finally, the state according to FIG. 1 is achieved.

If with a new setting operation the working tool is urged against the receiving material, the piston rod 17 of the driving piston 21 runs into the bottom-side of the passage opening 35 of the piston mounting 31, whereby now the piston rod 17 attempts to take along the braking spheres 32, 33 in the direction towards the muzzle. The braking spheres 32, 33 then run into the spring cage, so that they are compressed more powerfully in the direction towards the piston rod 17 by the spring cage 36. The piston rod 17 is therefore braked, so that upon further shifting of the housing 1 in the direction towards the receiving material 18 of the piston head 20 ultimately transported up to its rearward end position in the piston guide cylinder 22 due to the action of the braking spheres 32, 33. The return of the braking piston 21 into its starting position situated in piston guiding cylinder 22 thus occurs always at the time of an application operation, wherein the setting tool is urged against the receiving material—. For this purpose the piston mounting 31 is provided, which in this application operation the braking piston 21 is carried via its piston rod 17 into its starting position.

A second exemplary embodiment of the present invention will now be described with reference to FIGS. 5 to 8. Similar elements as those in FIGS. 1 to 4 are identified using the same references numerals and will not be described again.

In contrast with the exemplary embodiment according to FIG. 1, the compression spring 30 now is found, as before, inside the guide sleeve 9, between the receiving assembly 12 and the piston brake bearing 23. Furthermore, the piston brake bearing 23 is no longer fixedly connected with the piston guiding cylinder 22, but is displaceable relative to same in the axial direction of the piston guiding cylinder 22. The piston guiding cylinder 22 and piston brake bearing 23 are held slidingly displaceable in the guide sleeve 9, which now no longer has an inner peripheral flange. The external diameter of the piston braking bearing 23 and the piston guiding cylinder 22 are the same.

In the following the mode of operation of the setting tool will be more completely described according to the second exemplary embodiment.

Figure 5:
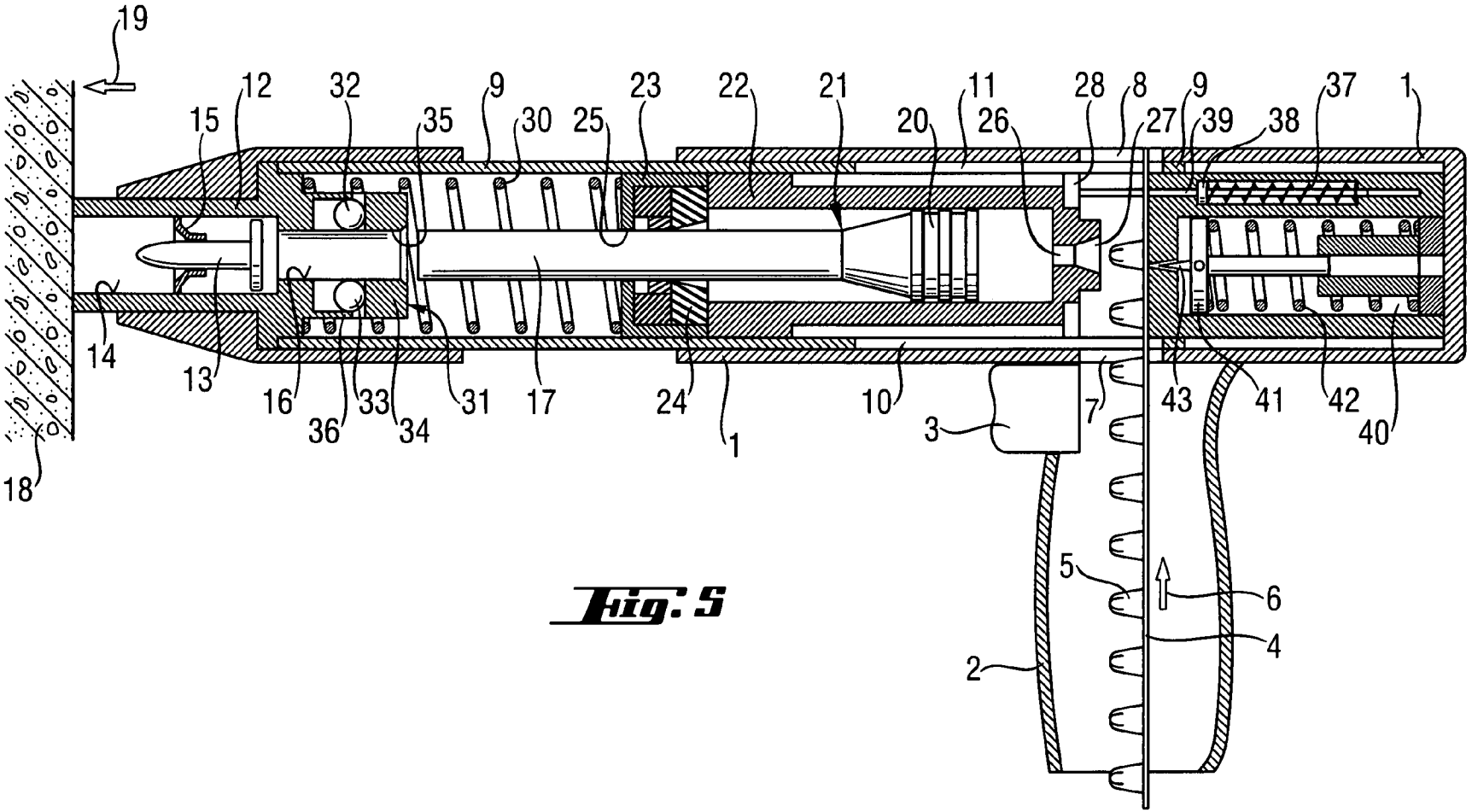
FIG. 5 represents an axial section through a setting tool according to the second exemplary embodiment of the invention in the extended state.
Figure 6:
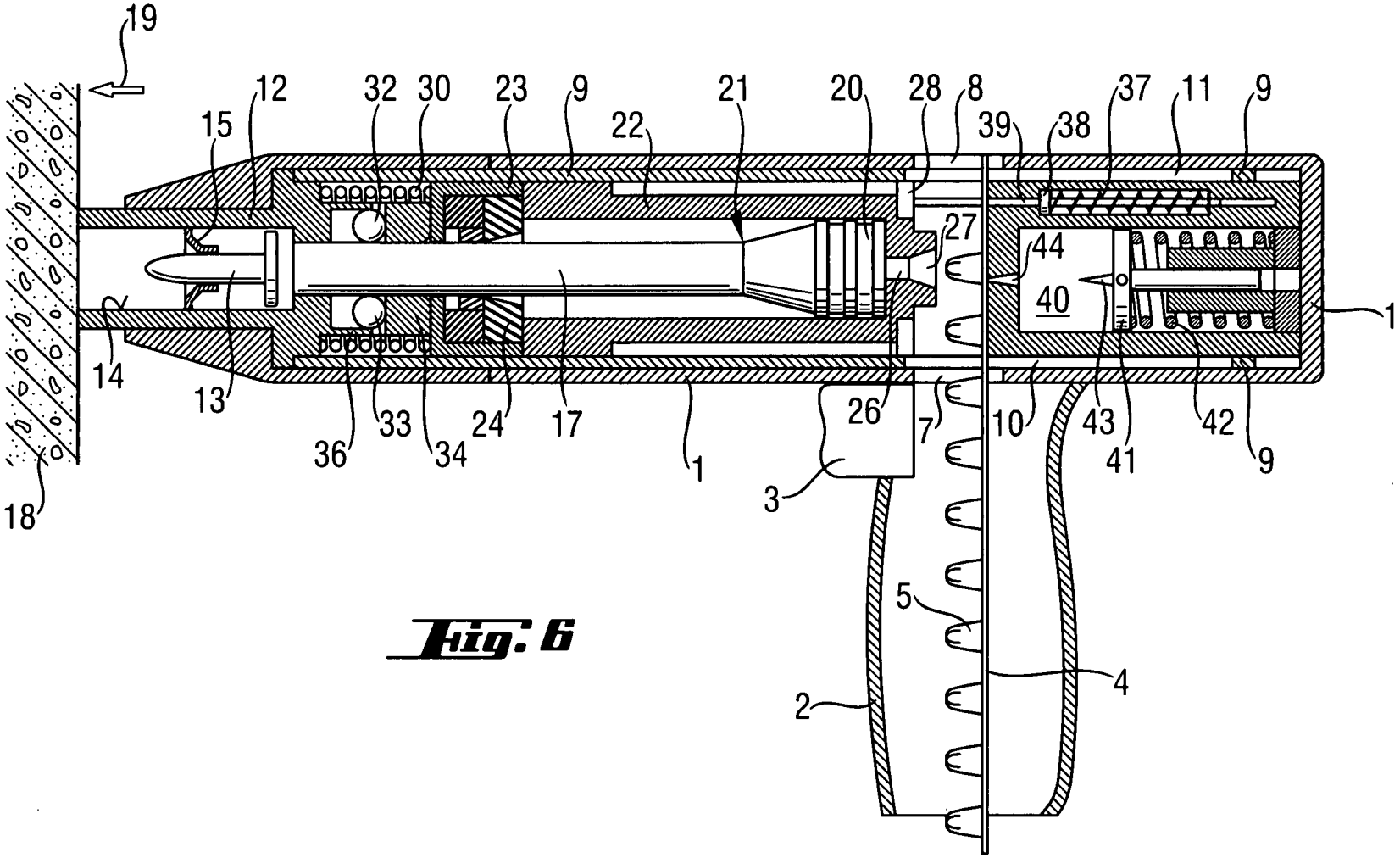
FIG. 6 represents the setting tool according to FIG. 5 upon application on the receiving material.

FIG. 5 represents the setting tool in the completely extended state. The compression spring urges the piston guiding cylinder 22 via the peripheral flange 28 in the direction towards the muzzle so that the transport of the cartridges 5 in the magazine transport direction 6 is possible. The compression spring 42 is not tensioned. The compression spring 30 is supported via the piston brake bearing 23 and the piston guiding cylinder 22 on the spring 37 and pushes the receiving assembly 12 farthest forward.

If the setting tool is pressed with its muzzle against the receiving material 18, the compression spring 30 is initially compressed, because it is weaker than the compression spring 37. The piston guiding cylinder 22 thus holds its spacing from the cartridge magazine, while on the other hand the receiving assembly 12 is shifted in the direction towards the piston guiding cylinder 22. This continues until the piston mounting 31 fixedly connected to the receiving assembly 12 impacts against the piston brake bearing 23 and thus impacts against the muzzle side end of the piston guiding cylinder 22. The compression spring 30 is now maximally compressed. With this movement, the receiving assembly 12 takes along the guide sleeve 9 rearwardly, so that via the guide disk 41 is also taken rearwardly and the compression spring 42 is compressed. At the same time, with the movement of the receiving assembly 12 rearward or away from the muzzle, the piston mounting 31 is taken along, so that via the brake spheres 32, 33 the piston rod 17 is also correspondingly taken along and thus the piston head 20 is moved into its rearmost starting position inside the piston guiding cylinder 22.

Figure 7:
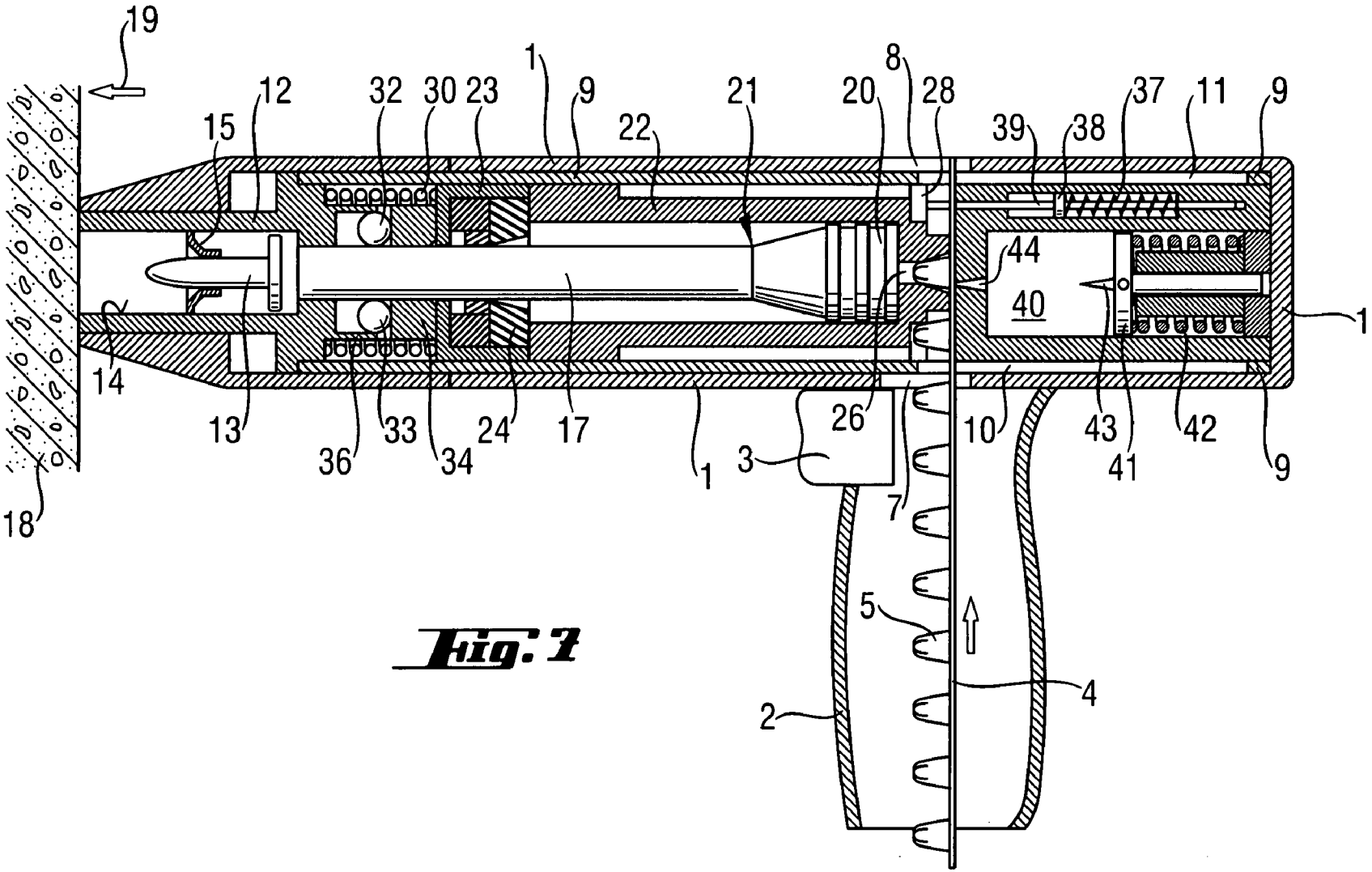
FIG. 7 represents the setting tool according to FIG. 5 in the applied state.

With a further displacement of the housing 1 in the direction towards the receiving material 18, the force of the compression spring 37 is finally overcome and the firing chamber 27 is now positioned over a cartridge 5 situated in the firing position. Because when this is done, the guide sleeve 9 is shifted rearward, the compression spring 42 is further compressed by means of the guide disk 41. This state is represented in FIG. 7.

Figure 8:
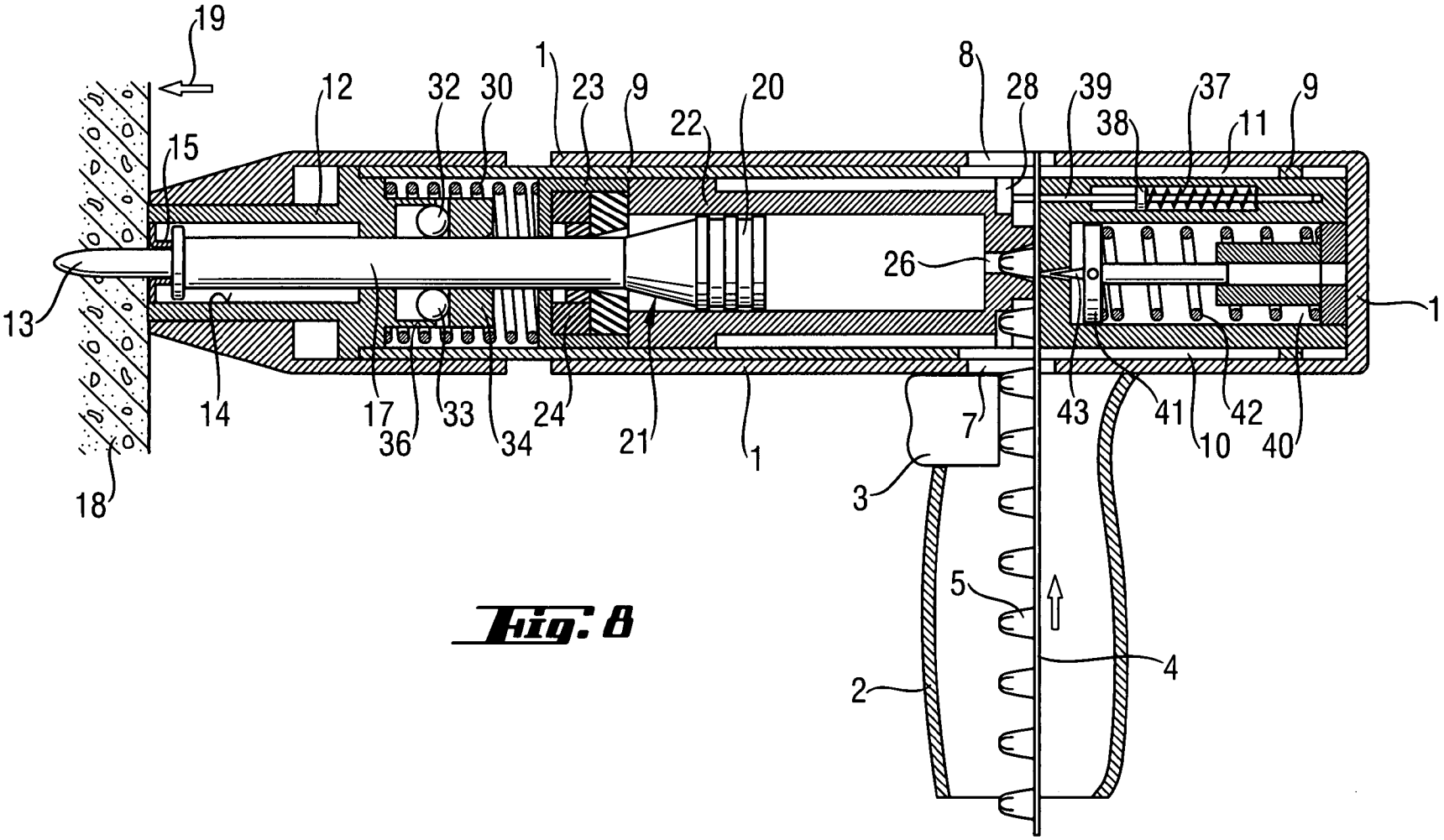
FIG. 8 represents the setting tool according to FIG. 5 after setting a fastener and not yet in the extended state.

Upon operation of the trigger the guide disk 41 is unlocked and the compression spring 42 drives the firing pin 43 through the firing channel 44 in the direction of the cartridge 5 and then fired. The driving piston 21 is driven forward and overcomes the friction of the braking spheres 32, 33. The fastening element 13 is driven into the receiving material 18. This state is shown in FIG. 8, whereby, in by virtue of the slight recoil that occurs, the unit housing 1 was again removed somewhat from the receiving material 18. With the contact of the piston heads 20 on the damping cushion 24, the piston brake bearing 23 is removed from the piston guiding cylinder 22, so that it is not stressed. Moreover, the forces upon piston stopping are conducted via the piston brake bearing 23, the piston mounting 31 and the receiving assembly 12 into the receiving material—.

If now the unit housing 1 is removed from the receiving material 18, the compression spring 27 urges the piston guiding cylinder 22 in the direction of the muzzle, so that now a replacement of the cartridge 5 is possible. At the same time, the compression spring 30 urges the receiving assembly 12 in the direction of the muzzle, so that the braking spheres 32, 33 roll away via the piston rod 17, without picking it up. The friction between the braking spheres 32, 33 and the piston rod 17 is practically zero, since in the movement the receiving assembly 12, in the direction of driving direction 19, the braking spheres 32, 33 run out of the conical spring cage 36 axially rearwardly. Finally, the state according to FIG. 5 is achieved.

What is claimed is:

1. A combustion-driven setting tool for fastening elements, having a unit housing (1);

a piston guiding cylinder (22), which is mounted in the unit housing (1) for displacement in a longitudinal direction of the guiding cylinder;

a piston (21) guided in a piston guiding cylinder (22) for driving in a fastening element (13) into a receiving material (18);

a receiving assembly (12) situated coaxially to the piston guiding cylinder (22) for the fastening element (13), which, viewed in a driving direction (19), lies in front of the piston guiding cylinder (22) and can be displaced relative thereto;

an elastic adjustment assembly (30), which constantly tends to separate the receiving assembly (12) and the piston guiding cylinder (22) from each other; and a piston mounting (31), which is secured to an end of the receiving assembly (12) facing towards the piston guiding cylinder (22), wherein the receiving assembly (12) passes into a guide assembly (9) at its end facing away from the driving direction (19), which on the one hand is displaceably held in the unit housing (1) in the longitudinal direction of the piston guiding cylinder (22), and on the other hand displacingly receives the piston guiding cylinder (22).

2. The setting tool according to claim 1, wherein the piston mounting (31) is so configured that with a withdrawn piston (21) there occurs a frictional force between it and the piston (21) when the piston (21) moves in the driving direction (19) or the piston mounting (31) moves in a direction opposite the driving direction (19).

3. The setting tool according to claim 2, wherein the piston mounting (31) has roller elements (32, 33), which abut a circumference of the piston (21) applying pressure thereto when the piston (21) moves in the driving direction (19) or the piston mounting (31) moves in a direction opposite the driving direction (19).

4. The setting tool according to claim 1, wherein the guide assembly is configured as a guide sleeve (9).

5. The setting tool according to claim 1, wherein said elastic adjusting assembly (3) is formed as an axially extending compression spring (30) arranged between an inner stop (29) on said guide sleeve (9) and in a direction opposite the driving direction, against a peripheral flange (28) of said piston guiding cylinder (22) at a trailing end of said piston guiding cylinder.

6. The setting tool according to claim 4 wherein said elastic adjusting assembly is formed as an axially extending compressing spring (3)) arranged within said guide assembly (9) between the piston mounting (31) and the piston guiding cylinder (22).

7. The setting tool according to claim 6, wherein a front end of said piston guiding cylinder (22) carries a piston brake bearing (23).

8. The setting tool according to claim 7, wherein the piston brake bearing (23) can be axially displaceable within said guide sleeve (9) into contact with said piston mounting (31).

* * * * *